US007496984B2

(12) United States Patent
Pang

(10) Patent No.: US 7,496,984 B2
(45) Date of Patent: Mar. 3, 2009

(54) FLOOR CLEANING APPARATUS WITH ELONGATE HANDLE AND HANDLE EXTENSION

(75) Inventor: Kwok Fung Pang, Hong Kong (CN)

(73) Assignee: Kwonnie Electrical Products Limited, Hong Kong (HK)

( * ) Notice: Subject to any disclaimer, the term of this patent is extended or adjusted under 35 U.S.C. 154(b) by 10 days.

(21) Appl. No.: 11/757,491

(22) Filed: Jun. 4, 2007

(65) Prior Publication Data

US 2008/0155774 A1 Jul. 3, 2008

(30) Foreign Application Priority Data

Dec. 29, 2006 (CN) ..... 2006 2 0173500 U

(51) Int. Cl.
*A47L 13/42* (2006.01)
*B25G 1/06* (2006.01)

(52) U.S. Cl. ..... 15/144.1; 15/144.2

(58) Field of Classification Search ..... 15/41.1, 15/144.1, 144.2
See application file for complete search history.

(56) References Cited

U.S. PATENT DOCUMENTS

| | | | | |
|---|---|---|---|---|
| 2,980,457 | A * | 4/1961 | Page | 15/245 |
| 4,654,922 | A * | 4/1987 | Chen | 15/172 |
| 6,032,321 | A * | 3/2000 | Shirey et al. | 15/244.2 |
| 6,279,189 | B1 * | 8/2001 | Cassar | 15/144.1 |
| 7,055,204 | B2 * | 6/2006 | Ajluni | 15/121 |
| 2002/0078519 | A1 * | 6/2002 | Boothby | 15/121 |
| 2004/0244131 | A1 * | 12/2004 | Cassar | 15/144.2 |

* cited by examiner

*Primary Examiner*—Randall Chin
(74) *Attorney, Agent, or Firm*—Leydig, Voit & Mayer, Ltd.

(57) ABSTRACT

A floor sweeping apparatus comprises a cleaning head with an elongate handle fixed at an inner end by a pivoting joint to the cleaning head, and at an outer end by a hinge to an elongate handle extension. A locking mechanism allows the handle extension to be locked in different angular positions relative to the handle and can be remotely controlled from the handle extension.

5 Claims, 5 Drawing Sheets

FLOOR CLEANING APPARATUS WITH ELONGATE HANDLE AND HANDLE EXTENSION

TECHNICAL FIELD

The present invention relates to domestic appliances and more specifically floor-care equipment such as, but not limited to, sweepers.

BACKGROUND

A common modern floor sweeper has a cleaning head to which an elongate handle is mounted, the cleaning head holding at least one motorized rotating brush for sweeping debris from the floor, and a receptacle for collecting the debris. The handle is typically an elongate tubular member, comprising one or more predominantly straight sections, with a handgrip attached at its outer end. The handle is normally connected to the cleaning head via a pivoting or universal joint and some joint designs permit steering of the cleaning head by twisting the handle.

With a handle of suitable length the user can maintain an upright stance using floor sweepers of this type for cleaning open floor areas, however while maintaining this stance the ability to clean beneath furniture is restricted. For instance, to sweep under a bed or sofa, the user must bend or kneel down until the handle is almost horizontal. This action is difficult to achieve in tight spaces, and may be uncomfortable or difficult for some users. Accordingly there is a need for an improved floor cleaning device such as a sweeper, that allows the user quickly and easily can clean under furniture.

It will be understood that any improved floor cleaning device should not only be adapted to function in a efficient and simple manner, but also with a small number of simple parts for ease of manufacture and assembly. It is therefore an object of the present invention to overcome or substantially ameliorate the above disadvantages or more generally to provide an improved floor cleaning apparatus.

DISCLOSURE OF THE INVENTION

In one aspect the invention provides a floor cleaning apparatus comprising:

a floor-supported cleaning head;

an elongate handle connected at its inner end by a pivoting joint to the cleaning head, and characterised in that an elongate handle extension is connected by a hinge to an outer end of the handle.

Preferably the hinge is pivotable about any one of a plurality of axes. For example, the hinge may comprise a spherical joint or a flexible member permitting pivoting between the handle and handle extension by flexure of the hinge. The flexible member may be resilient.

Preferably the hinge includes a pivot defining a transverse pivot axis.

The apparatus preferably includes a locking mechanism allowing the handle and handle extension to be fixed in at one relative angular position.

Preferably the locking mechanism comprises:

a lock fixed to one of the handle and handle extension;

a lock-engaging feature on the other of the handle and handle extension;

spring means for biasing the lock to engage the lock-engaging feature for preventing relative rotation at a first relative angular position, and a button actuable to release the lock and free the handle and handle extension to pivot about the hinge.

Preferably in the first relative angular position the handle and handle extension are substantially aligned. Preferably, the button is pivotally mounted and biased away from engagement with the lock, and to release the lock, the button is first moved to engage the lock and further movement of the button displaces the lock against the bias of the spring means.

The hinge may allow the handle assembly to assume two extreme positions, where one position is the 180 degree position giving the equivalent to a normal straight handle, and the other is in the region of 90-135 degrees giving the whole handle approximately an L-shape.

BRIEF DESCRIPTION OF THE DRAWINGS

The present invention may take physical form in certain parts and arrangement of parts, several embodiments of which are possible. The preferred embodiment of the invention is described in detail below with reference to the attached drawings wherein.

DETAILED DESCRIPTION OF THE PREFERRED EMBODIMENT

Figure 1A:
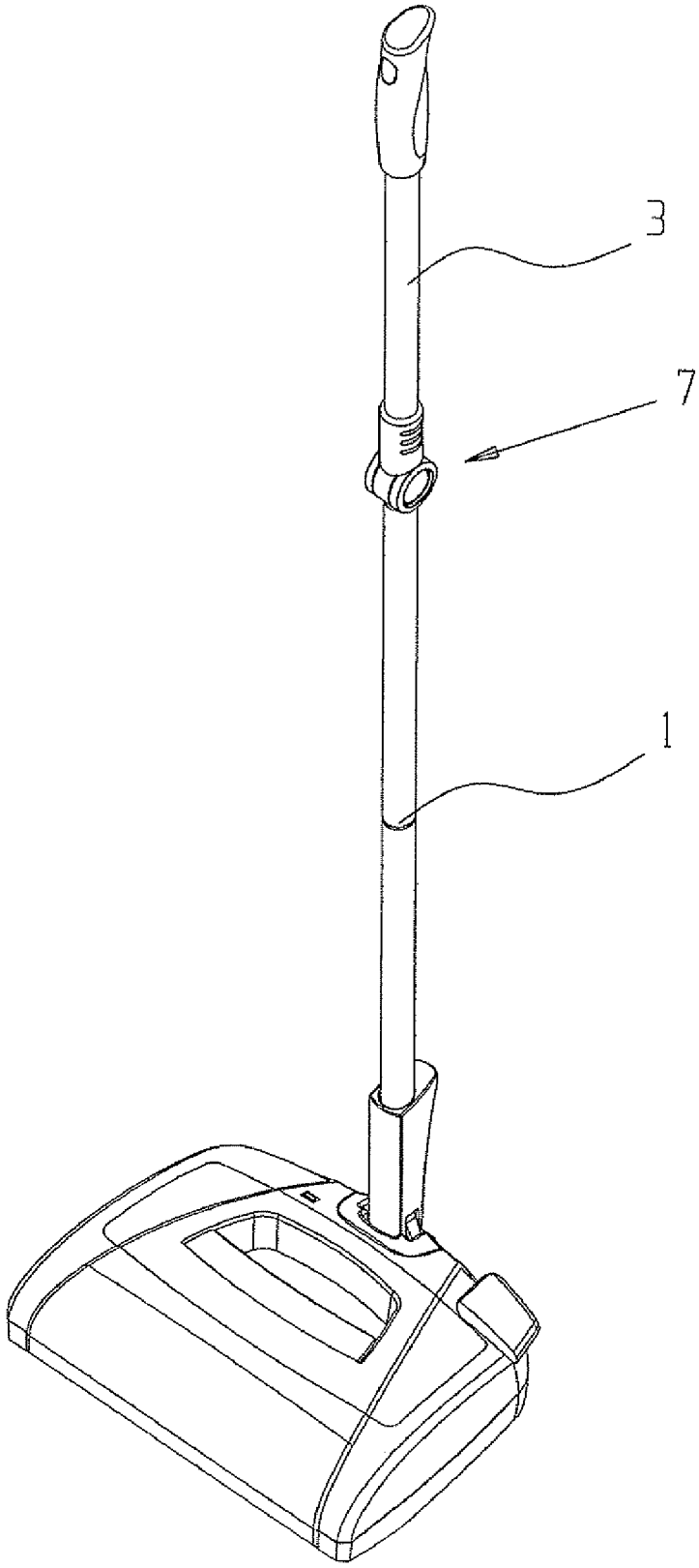
FIGS. 1*a* and 1*b* are perspective views of a floor cleaning apparatus in accordance with the preferred embodiment of the invention and showing first and second operating configurations respectively.

Referring now to the drawings, which illustrate the preferred embodiment of the invention only and not intended to limit the same; we shall first clarify the parts and then the function.

Figure 1B:
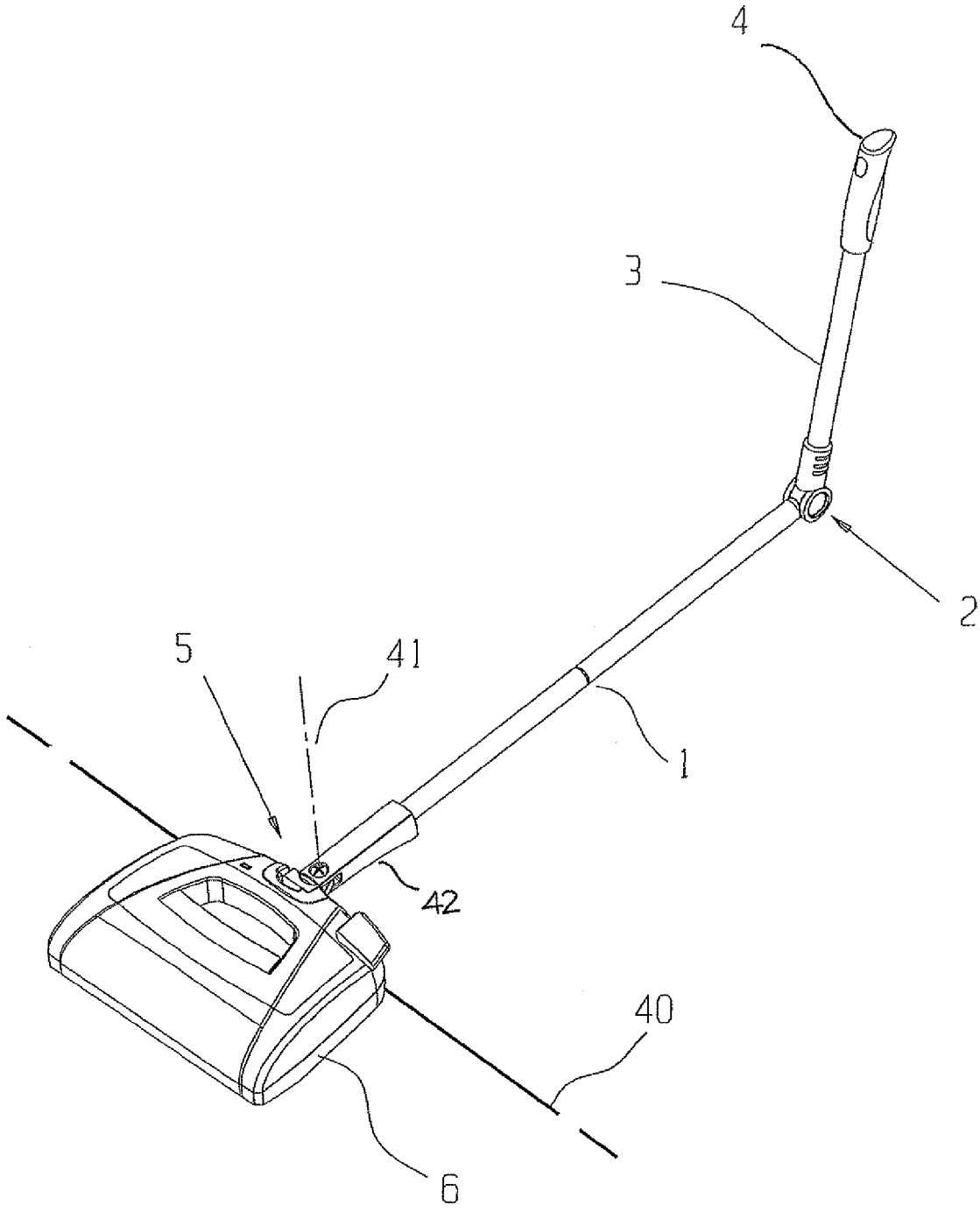

FIGS. 1*a* and 1*b* illustrates a sweeper in first and second operating configurations respectively. The sweeper includes a cleaning head 6 and a handle assembly 7. The handle assembly 7 includes an elongate handle 1 connected at its inner end by a pivoting steering joint 5 to the cleaning head 6, and at its outer end by a hinge 2 to an elongate handle extension 3. The terms "inner" and "outer" refer respectively to the longitudinally opposing ends closest to, and farthest from the attachment to the cleaning head. The handle 1 is approximately twice the length of the handle extension 3. A grip 4 is provided on the outer end of the handle extension 3. In the first configuration (FIG. 1*a*) the handle assembly 7 is shown configured for normal use, with the handle 1 and handle extension 3 aligned parallel. In the second configuration (1*b*) the handle extension 3 is approximately at 90 degrees to the handle 1 for use under low furniture etc.

The cleaning head 6 holds debris-collecting means including a rotating brush (not shown) cooperating with a removable dust pan (not shown). The brush is driven via a belt (not shown) by a motor (not shown) powered by rechargeable batteries (not shown). Centrally placed at the rear of the sweeper is the pivoting steering joint 5 for connection to the handle assembly 7. The steering joint 5 is a universal joint, freely pivoting about a transverse axis 40 and a perpendicular steering axis 41 which gives the user freedom to move the handle assembly 7 at any angle as well as articulating the cleaning head 6. An extended portion 42 of the steering joint 5 has a recess (not shown) for receiving the handle 1.

Figure 2A:
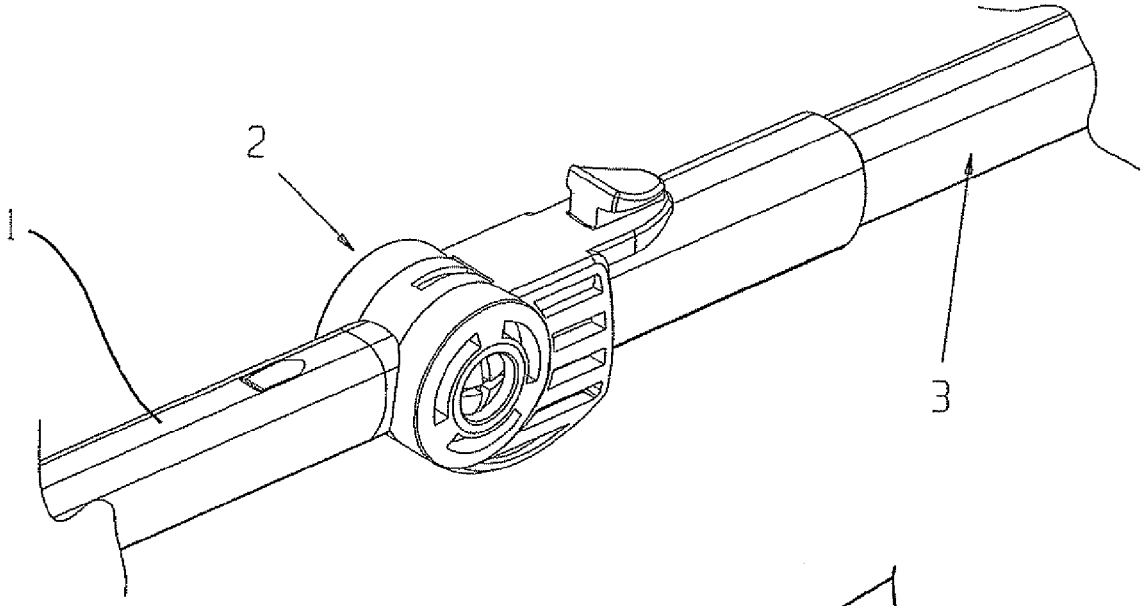
FIG. 2*a* is a perspective view of the hinge of the apparatus of FIGS. 1*a* and 1*b;*
Figure 2B:
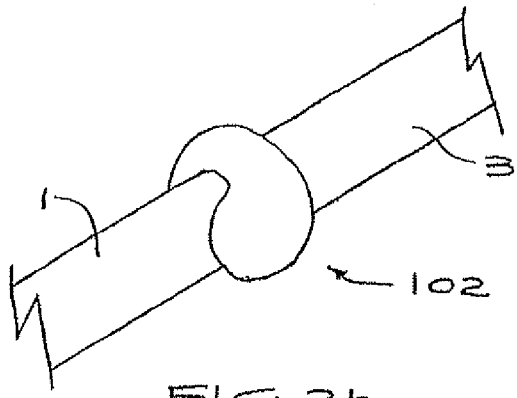
FIG. 2*b* is a perspective view of an alternative hinge.

FIG. 2*a* shows the assembled hinge 2 in more detail. FIG. 2*b* shows an alternative hinge 102 for joining the handle 1 and handle extension 3 and includes a generally spherical portion formed from an elastomer. Flexure of the hinge 102 permits pivoting about any one of a plurality transverse axes.

Figure 3:
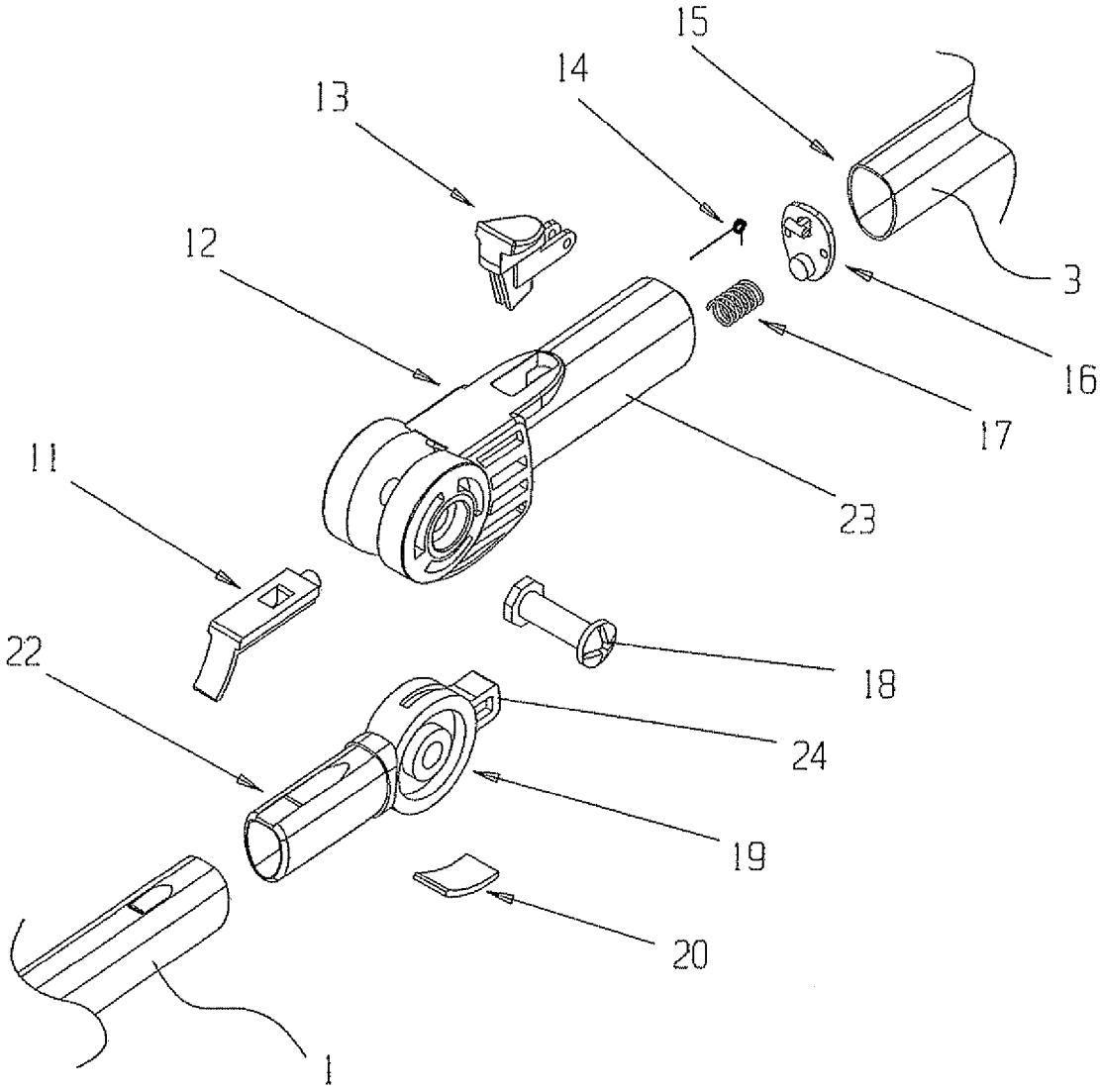
FIG. 3 is an exploded view of the hinge of FIG. 2*a*.

Referring now to FIG. 3, the hinge 2 consists of and inner joint 19 having a spigot portion 22 received in the hollow outer end of the handle 1 and an outer joint 12 having a sleeve portion 23 in which the inner end of the handle extension 3 is received. The inner and outer joint 19, 12 are held together by a transversely extending pivot bolt 18, which defines the pivoting axis. Protruding on the opposite side of the inner joint 19 from the spigot portion 22 is a lock tab 24.

Inside sleeve portion 23, a joint cap 16 is seated against internal ribs so that about one-half of the joint cap is inside the sleeve portion 23. Handle extension 3 fits into sleeve portion 23 with a press fit, holding joint cap 16 in place. On joint cap 16 are protruding features to hold compression-type lock spring 17 and torsion-type button spring 14 in place. Joint cap 16 has an axle feature 25 onto which a button 13 hinges, whilst held under outward pressure by button spring 14. Inside the sleeve portion 23 is a lock 11, which slidably fits into a guide track, allowing it about preferably, 10 mm of straight-line movement in the longitudinal direction. Lock 11 is at one end in press-fit contact with lock spring 17, which biases the movement of lock 11 to its forward, or locked, position. The other end of lock 11 has a locking feature 29, which controls the freedom of movement of inner joint 19. And, finally, lock cover 20 fits into the aperture of outer joint 12, through which other components are assembled, in order to cover the mechanism and close the outside surface.

Figure 4:
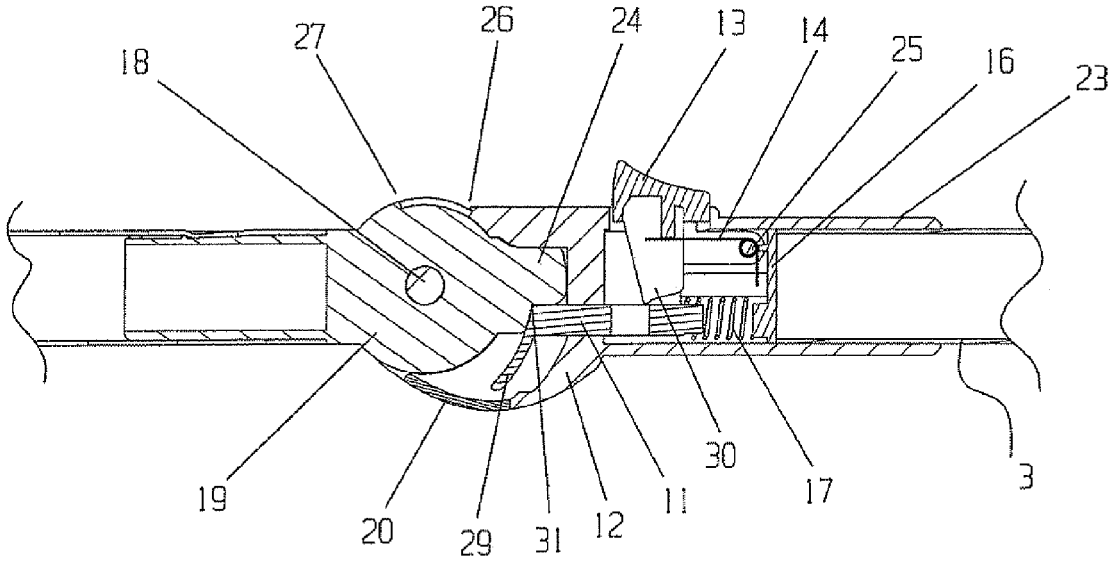
FIG. 4 is a longitudinal cross-section through the hinge of FIG. 2*a.*

Focusing now on the function of hinge 2 and referring to FIG. 4, we can define the two subsystems in the hinge assembly: the locking mechanism and the pivot movement.

The locking mechanism consists of lock 11, outer joint 12, button 13, button spring 14, and lock spring 17 and has two positions: locked and open. The pivot which provides pivoting movement consists of inner joint 19, outer joint 12, and pivot bolt 18. The pivoting movement extends between two extreme angular positions, one at 180° (normal mode) and the other perpendicular to the normal mode at 90° (fully flexed mode). The locking mechanism, in the locked position, locks the hinge 2 at the 180°-position and, in the open position, permits free movement between the two extreme angular positions at 90° and 180°. With the locking mechanism in the open position, the pivot movement is only restricted by its end travel stops. With the locking mechanism actuated, the hinge is free to move until it reaches 180° position and is automatically locked in that position.

Still referring to FIG. 4, button 13 is hingedly attached to joint cap 16 at button pivot 25 and biased in the clockwise direction by button spring 14. When button 13 is pressed and rotated in the anticlockwise direction (in the orientation shown), a button angled face 30 will engage and apply a force to lock 11 and cause it to move towards lock spring 17 against the spring bias. Lock 11 is slidably mounted in guide rails in outer joint 12 and has a locking edge 31 and a locking rib 29. With button 13 released and with inner joint 19 and outer joint 12 in the 180° position, lock 11 is in its locked position, with the lock 11 received in the lock-engaging feature or locking recess 31 under lock tab 24 securing inner joint 19 in place. With button 13 pressed, lock 11 will be moved backwards to the open position until lock tab 24 can pass locking recess 31, and inner joint 19 is released from its lock position and is free to flex in the clockwise direction. The locking rib 29 will force lock 11 to stay open until inner joint 19 comes back to 180°, even if button 13 is not pressed.

The clockwise movement of inner joint 19 is restricted at 180° by lock 11, if in locked position, and in the anticlockwise direction at 180° by the inside of the upper wall of outer joint 12, indicated at 26. The clockwise movement at 90° is restricted when edge 28 of inner joint 19 touches edge 27 of outer joint 12. Anticlockwise has no restriction at 90°.

The invention claimed is:

1. A floor sweeper comprising:

a floor-supported cleaning head;

a elongate handle having longitudinally opposing inner and outer ends and a longitudinal handle axis;

a joint connecting the inner end of the handle to the cleaning head so that the handle may pivot with respect to the cleaning head about first and second mutually perpendicular axes, the first axis extending perpendicular to the longitudinal handle axis;

an elongate handle extension having longitudinally opposing inner and outer ends and a longitudinal handle-extension axis;

an outside joint and an inside joint, the inside joint being received within the outside joint;

a pivot connecting the inside joint to the outside joint and defining a pivot axis extending transverse to the longitudinal handle axis;

first and second coupling portions respectively integral with the inside and outside joints, each of the first and second coupling portions receiving, or being received within, a respective one of the handle and the handle extension, so that the pivot and the inside and outside joints, collectively, provide a hinged connection between the outer end of the handle and the inner end of the handle extension;

a lock disposed within the one of the inside and outside joints that is connected to the handle extension, having a first section, and reciprocatingly sliding parallel to the longitudinal handle-extension axis;

a spring engaging the lock;

a recess complementary in shape to the first section of the lock, disposed within the one of the inside and outside joints that is connected to the handle, and positioned so that, when the longitudinal handle axis and the longitudinal handle-extension axis are substantially aligned, the spring urges the first section of the lock into the recess, thereby preventing relative rotation between the inside and outside joints; and a button mounted on the one of the inside and outside joints that is connected to the handle extension, the button being actuable to move the lock against a biasing force provided by the spring, thereby freeing the handle and the handle extension for pivoting relative to each other, about the pivot axis.

2. The floor sweeper according to claim 1, wherein the one of the inside and outside joints that is connected to the handle extension is the outside joint, and the button protrudes from an opening in the outside joint.

3. The floor sweeper according to claim 2, wherein the button is longitudinally spaced from the pivot axis.

4. The floor sweeper according to claim 1, wherein the first coupling portion comprises a spigot received in one of the handle and the handle extension.

5. A floor sweeper comprising:

a floor-supported cleaning head;

a elongate handle having longitudinally opposing inner and outer ends and a longitudinal handle axis;

a universal joint connecting the inner end of the handle to the cleaning head so that the handle may pivot with respect to the cleaning head about first and second mutually perpendicular axes, the first axis extending perpendicular to the longitudinal handle axis;

an elongate handle extension having longitudinally opposing inner and outer ends and a longitudinal handle-extension axis;

an outside joint and an inside joint;

a pivot connecting the inside joint to the outside joint and extending transverse to the longitudinal handle axis;

first and second coupling portions respectively integral with the inside and outside joints, the first and second coupling portions respectively connecting the corresponding inside and outside joints to the handle and the handle extension;

a lock disposed within the one of the inside and outside joints that is connected to the handle extension, having a first section, and reciprocatingly sliding parallel to the longitudinal handle-extension axis;

a spring engaging the lock;

a recess complementary in shape to the first section of the lock, disposed within the one of the inside and outside joints that is connected to the handle, and positioned so that, when the longitudinal handle axis and the longitudinal handle-extension axis are substantially aligned, the spring urges the first section of the lock into the recess, thereby preventing relative rotation between the inside and outside joints; and a button mounted on the one of the inside and outside joints that is connected to the handle extension, the button being actuable to move the lock against a biasing force provided by the spring, thereby freeing the handle and the handle extension for pivoting relative to each other, about the pivot axis.

* * * * *